United States Patent [19]

Tani

[11] 4,030,927

[45] June 21, 1977

[54] SUPERSENSITIZING COMBINATIONS OF HALOGEN SUBSTITUTED BENZOTRIAZOLES AND CYANINE DYES

[75] Inventor: Tadaaki Tani, Kanagawa, Japan

[73] Assignee: Fuji Photo Film Co., Ltd., Kanagawa, Japan

[22] Filed: Jan. 14, 1976

[21] Appl. No.: 649,000

[30] Foreign Application Priority Data

Jan. 16, 1975 Japan ..... 50-7309

[52] U.S. Cl. ..... 96/100; 96/109; 96/126

[51] Int. Cl.[2] ..... G03C 1/14; G03C 1/19; G03C 1/34; G03C 1/40

[58] Field of Search .... 96/126, 132, 109, 133–138, 96/122, 100

[56] References Cited

UNITED STATES PATENTS

| | | | |
|---|---|---|---|
| 2,566,167 | 8/1951 | Carroll et al. | 96/126 |
| 3,457,078 | 7/1969 | Riester | 96/109 |
| 3,592,656 | 7/1971 | Brooks | 96/126 |
| 3,622,316 | 11/1971 | Bird et al. | 96/132 |
| 3,671,255 | 6/1972 | Haga et al. | 96/109 |

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A silver halide photographic emulsion supersensitized by a combination of (1) at least one cyanine sensitizing dye containing therein two 5- or 6-membered nitrogen-containing heterocyclic nuclei which may be the same as or different from each other and which are attached, through a conjugated methine chain consisting of three, five or seven methine groups, to each other, and (2) a benzotriazole substituted with at least one halogen atom, both (1) and (2) being present in a supersensitizing amount. The emulsion shows reduced fog and intensified spectral sensitivity than an emulsion containing the cyanine dye alone.

21 Claims, No Drawings

SUPERSENSITIZING COMBINATIONS OF HALOGEN SUBSTITUTED BENZOTRIAZOLES AND CYANINE DYES

BACKGROUND OF THE INVENTION

1. Field of the Invention

The present invention relates to a spectrally sensitized silver halide photographic emulsion, more particularly, to an improvement in the spectral sensitivity of silver halide photographic emulsions containing a carbocyanine, dicarbocyanine or tricarboxyanine dye.

2. Description of the Prior Art

In the art of manufacturing silver halide photographic emulsions, it is often desired to impart heightened spectral sensitivity to a silver halide photographic emulsion. Both chemical and spectral sensitization techniques are known as useful methods for increasing the sensitivity of a silver halide photographic emulsion.

Spectral sensitization is a technique of increasing the sensitivity of photographic emulsions which is based upon an extension of the spectral sensitization region inherent to silver halide photographic emulsions (which ranges over the visible short wave-length region to the visible long wave-length region) by incorporating sensitizing dyes in a silver halide photographic emulsion.

Cyanine dyes are predominantly used as such sensitizing dyes. Besides the cyanine dyes, a number of sensitizing dyes and procedures for using the same are known. Particularly, combinations of two or more kinds of sensitizing dyes or combinations of a sensitizing dye and a compound having no or an extremely poor spectral sensitizing property per se have been employed to obtain a greater spectral sensitization effect than the spectral sensitization effect attained by the use of an individual sensitizing dye alone. The increased spectral sensitization caused by the combined use of the above materials is called supersensitization.

Supersensitization has long been known. Various carbocyanine or dicarbocyanine dyes, as well as other cyanine dyes, having a supersensitizing effect are known. For example, as disclosed in U.S. Pat. Nos. 3,397,060; 3,522,052 and 3,527,641; British Pat. No. 1,216,203; German (OLS) No. 2,030,326 and so on. However, as is often the case with supersensitizing compounds, changes in the spectral sensitization wavelength region resulting from the addition of a supersensitizing agent (which takes place when the supersenitizing agent employed is a spectral sensitizing dye itself) impair the favourable spectral characteristics which the photographic emulsion gained. Therefore, techniques of supersensitizing photographic emulsions by taking advantage of the compounds which do not have a spectral sensitizing action in themselves have been desired.

Benzotriazole compounds are known as antifoggants for photographic emulsions, and they have been employed to reduce fog. However, it is also known that these compounds often have a desensitization action. For example, see "Action of Organic Stabilizers on a Photographic Emulsion" by Thomas R. Tomson, published in *Photographic Science and Engineering*, volume 3, page 272 (1959) or "Interaction of Benzotriazole with Development and Fog Centers" by M. R. V. Sahyun, published in *Photographic Science and Engineering*, volume 15, page 48 (1971).

SUMMARY OF THE INVENTION

However, we unexpectly found that the addition of a halogenated benzotriazole compound to a silver halide photographic emulsion containing a carbocyanine, dicarbocyanine or tricarbocyanine dye, or mixtures thereof, causes a remarkable increase in photographic sensitivity.

It is, therefore, one object of the present invention to provide a silver halide photographic emulsion which is highly spectrally sensitized and which has reduced fog.

Another object of the present invention, is to provide a silver halide photographic emulsion having reduced fog and an intensified spectral sensitization based upon a carbocyanine, dicarbocyanine or tricarbocyanine dye, or mixture thereof, by the addition of a compound which does not have a spectral sensitization action in itself.

The above-described objects are attained by incorporating in a supersensitizing amount of a combination of;

1. at least one cyanine sensitizing dye which has a structure where two 5- or 6-membered nitrogen-containing heterocyclic nuclei having an aliphatic or an aryl group substituted nitrogen atom (which may be the same as or different from each other) are attached through a trimethine, pentamethine or heptamethine group (which may have at the meso-position thereof, an unsubstituted alkyl group, an aralkyl group, a carboxyalkyl group, a hydroxyalkyl group, an acetyl group, an alkoxy group, a thioalkoxy group, an aryl group or a substituted aryl group), to each other; and
2. a benzotriazole compound substituted with at least one halogen atom, which forms a slightly soluble salt by reacting with a silver ion, in a silver halide emulsion.

DETAILED DESCRIPTION OF THE INVENTION

The preparation methods, the characteristics and the usage of the above-described cyanine dyes have long been known. For example, see F. M. Hamer, "The Cyanine Dyes and Related Compounds (The Chemistry of Heterocyclic Compounds, volume 8)" (1964) or C. E. K. Mees & T. H. James "The Theory of the Photographic Process (The 3rd edition)", chapter 12, 1966.

The cyanine dyes of the present invention must contain at least one nitrogen atom, but can, if desired, contain other non-carbon atoms in the heterocyclic nucleus thereof. It is most preferred that the hetero atom which can be present in the nitrogen-containing heterocyclic nulcei of the cyanine dyes used in the present invention be a sulfur atom, an oxygen atom or a selenium atom (preferably a sulfur atom or an oxygen atom, in addition to a nitrogen atom).

A useful class of cyanine dyes employed in the present invention has the following general formula (I) (which represents a resonance structure);

Formula (I)

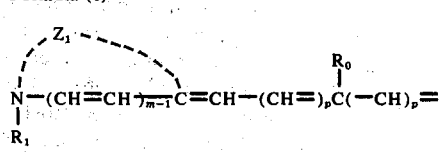

-continued

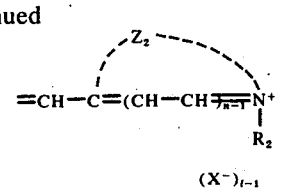

wherein $l$, $m$ and $n$ each represents 1 or 2, $p$ represents 0, 1 or 2, $R_0$ represents a hydrogen atom, an unsubstituted alkyl group (e.g., methyl, ethyl, propyl, butyl, etc.), a carboxylalkyl group (e.g., carboxymethyl, 2-carboxyethyl, etc.), a hydroxyalkyl group (e.g., 2-hydroxyethyl, 3-hydroxypropyl, etc.), an alkoxy group (e.g., ethoxy, etc.), an alkylthio group (e.g., ethylthio, etc.), an aralkyl group (e.g., benzyl, phenethyl, etc.) or an aryl group (e.g., phenyl, carboxyphenyl, etc.), wherein any alkyl group or alkyl moiety in another group, e.g., in alkylthio or alkoxy, contains from 1 to 8 carbon atoms, most preferably from 1 to 4 carbon atoms, and wherein any aryl group contains 1 or 2 condensed aromatic rings, and $X^-$ represents an inorganic or organic acid anion commonly used to form a dye salt in the cyanine dye art (e.g., a chloride ion, a bromide ion, an iodide ion, a perchlorate ion, p-toluenesulfonate ion, etc.), where the dye forms an intramolecular salt when $l$ equals 1.

$R_1$ and $R_2$ each represents an aliphatic group, including a saturated or unsaturated aliphatic group such as an alkyl group, which term includes both unsubstituted and substituted alkyl groups, e.g., unsubstituted alkyl groups preferably having up to 8 carbon atoms (e.g., methyl, ethyl, n-propyl, hexyl, etc.); substituted alkyl groups in which the alkyl moiety preferably has 1 to 4 carbon atoms (e.g., vinylmethyl, etc.) and those which include an aralkyl group (e.g., benzyl, phenethyl, etc), a hydroxyalkyl group (e.g., 2-hydroxyethyl, 3-hydroxypropyl, 4-hydroxybutyl, etc.), an acetoxyalkyl group (e.g., 2-acetoxyethyl, 3-acetoxypropyl, etc.), an alkoxyalkyl group (e.g., 2-methoxyethyl, 4-methoxybutyl, etc.), a hydroxysulfonyloxyalkyl group (e.g., 3-(hydroxysulfonyloxy)propyl, 4-(hydroxysulfonyloxy)butyl, etc.), a carboxy-substituted alkyl group (e.g., 2-carboxyethyl, 3-carboxypropyl, 2-(2-carboxyethoxy)ethyl, p-carboxybenzyl, etc.), a sulfo-substituted alkyl group (e.g., 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)propyl, 2-[2-(3-sulfopropoxy)ethoxy]ethyl, 2-hydroxy-3-(3'-sulfopropoxy)-propyl, p-sulfophenethyl, p-sulfobenzyl, etc.), etc.; or an aryl group (e.g., phenyl, etc.), wherein any alkyl group or alkyl moiety which is part of another group, e.g., alkoxy, preferably contains from 1 to 8 carbon atoms, most preferably from 1 to 4 carbon atoms, and wherein any aryl group or aryl moiety which is part of another group most preferably comprises 1 or 2 condensed aromatic rings.

$Z_1$ and $Z_2$ each represents a non-metallic atomic group necessary to complete a 5- or 6-membered nitrogen-containing heterocyclic ring. The heterocyclic nucleus may be substituted with an alkyl group having 1 to 4 carbon atoms, a monoaryl group, a halogen atom, an alkoxy group having 1 to 4 carbon atom, a carboxy group, a monoaralkyl group, where preferred alkyl moieties contain from 1 to 8 carbon atoms, most preferably from 1 to 4 carbon atoms, a trifluoromethyl group, a hydroxy group, an alkoxycarbonyl group (in which the alkyl moiety has 1 to 4 carbon atoms), a cyano group or other groups. In addition, a saturated or unsaturated aliphatic hydrocarbon group may form, for example, a 6-membered ring by undergoing condensation with the heterocyclic nucleus, for example, a (5, 6)- or (4, 5)-tetramethylene-benzotriazole, -benzoxazole or -benzoselenazole nucleus.

Examples of the heterocyclic nuclei $Z_1$ and $Z_2$ include thiazole nuclei (e.g., thiazole, 4-methylthiazole, 4-phenylthiazole, 4,5-dimethylthiazole, 4,5-diphenylthiazole, etc.); benzothiazole nuclei (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, 5-phenylbenzothiazole, etc.); naphthothiazole nuclei (e.g., naphtho[2,1-d]thiazole, naphtho[1,2-d]thiazole, naphtho[2,3-d]thiazole, 5-methoxynaphtho[1,2-d]thiazole, 8-methoxynaphtho[2,1-d]thiazole, 5-methoxynaphtho-[2,3-d]thiazole, etc.); thiazoline nuclei (e.g., thiazoline, 4-methylthiazoline, etc.); oxazole nuclei (e.g., oxazole, 4-methyloxazole, 4-ethyloxazole, etc.); benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, etc.); naphthoxazole nulcei (e.g., naphtho [2,1-d]oxazole, naphtho[1,2-d]oxazole, naphtho[2,3-d]oxazole, etc.); oxazoline nuclei (e.g., 4,4-dimethyloxazoline, etc.); selenazole nuclei (e.g., 4-methylselenazole, 4-phenylselenazole, etc.); benzoselenazole nuclei (e.g., benzoselenazole, 5-methoxybenzoselenazole, 5-methoxybenzoselenazole, 5-methylbenzoselenazole, 5-hydroxybenzoselenazole, etc.); naphthoselenazole nuclei (e.g., naphtho[2,1-d]-selenazole, naphtho[1,2-d]selenazole, etc.); 3,3-dialkylinodolenine nuclei (where preferred alkyl moieties have from 1 to 8 carbon atoms, most preferably from 1 to 4 carbon atoms, e.g., 3,3-dimethylindolenine 3,3-diethylindolenine 3,3-dimethyl-5-cyanoindolenine, 3,3-dimethyl-5-methoxyindolenine, 3,3-dimethyl-5-methylindolenine, 3,3-dimethyl-5-chloroindolenine, etc.); imidazole nuclei (including those which may be substituted with, for example, an alkyl group, an allyl group, an aryl group, an acetoxy group, a hydroxyalkyl group, a carboxyalkyl group, where for these last six substituents any alkyl group or alkyl moiety which is part of another group most preferably comprises from 1 to 4 carbon atoms and the aryl group comprises 1 to 2 condensed aromatic rings, or the like in the 1-position); such as 1-methylimidazole, 1-ethylimidazole, 1-methyl-4-phenylimidazole, 1-ethyl-4-phenylimidazole, etc.); benzimidazole nuclei (e.g., 1-methylbenzimidazole, 1-ethylbenzimidazole, 1-methyl-5-chlorobenzimidazole, 1-ethyl-5-chlorobenzimidazole, 1-methyl- 5,6-dichlorobenzimidazole, 1-ethyl-5,6-dichlorobenzimidazole, 1-ethyl-5-methoxybenzimidazole 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifluoromethylbenzimidazole, 1-ethylnaphtho[1,2-d]-imidazole, 1-allyl-5,6-dichlorobenzimidazole, 1-allyl-5-chlorobenzimidazole, 1-phenylimidazole, 1-phenylbenzimidazole, 1-phenyl-5-chlorobenzimidazole 1-phenyl-5,6-dichlorobenzimidazole, 1-phenyl-5-methoxybenzimidazole, 1-phenyl-5-cyanobenzimidazole, etc.); naphthoimidazole nuclei (e.g., 1-phenylnaphtho[1,2-d]-imidazole, 1-ethylnaphtho[1,2-d]imidazole, etc.); tetrazole nuclei (e.g., 1,3-dimethyltetrazole, 1-methyl-3-ethyltetrazole, etc.); pyridine nuclei (e.g., pyridine, 5-methyl-2-pyridine, 3-methyl-4-pyridine, etc.); quinoline nuclei (e.g., quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-di-hydro-1-isoquinoline, 6-nitro-3-isoquinoline, etc.); imidazo[4,5-b]quinoxaline nuclei (e.g., 1,3-dimethylimidazo[4,5-b]quinoxaline, 6-chloro-1,3-diallylimidazo[4,5-b]quinoxaline, etc.); and so on.

Useful groups of trimethinecyanine dyes used in the present invention have the following formulae (II) to (XIII), respectively.

Formula (II)

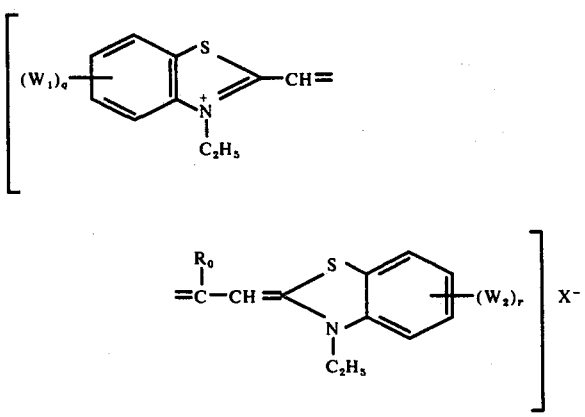

wherein $R_0$ and $X^-$ have the same meaning as in the general formula (I), $W_1$ and $W_2$ each represents a hydrogen atom an alkyl group having 1 to 4 carbon atoms, an aryl group, most preferably an aryl group which comprises 1 or 2 condensed aromatic rings, a halogen atom, an alkoxy group having 1 to 4 carbon atoms, a carboxy group, an aralkyl group, where the aryl moiety most preferably comprises 1 to 2 condensed aromatic rings, a trifluoromethyl group, a hydroxy group, an alkoxycarbonyl group (the alkyl moiety of which has 1 to 4 carbon atoms) or a cyano group and $q$ and $r$ each represents an integer ranging from 1 to 4.

Formula (III)

-continued

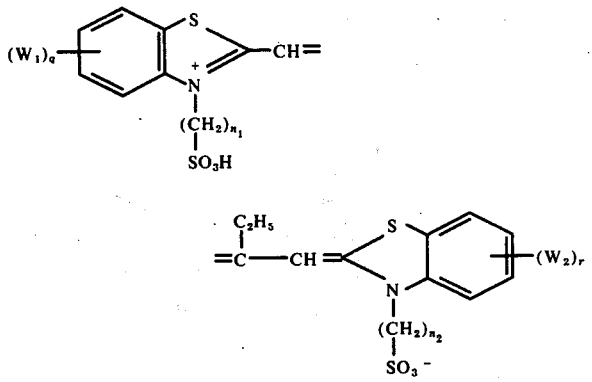

wherein $W_1$, $W_2$, $q$ and $r$ each has the same meaning as given in general formula (II) and $N_1$ and $n_2$ each is an integer of from 2 to 4.

Formula (IV)

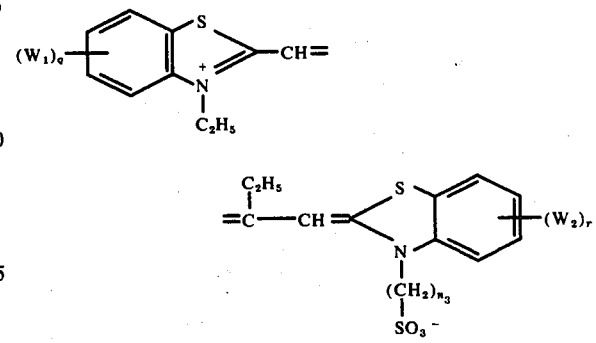

wherein $W_1$, $W_2$, $q$ and $r$ each has the same meaning as in the general formula (II) and $n_3$ represents an integer of from 2 to 4.

Formula (V)

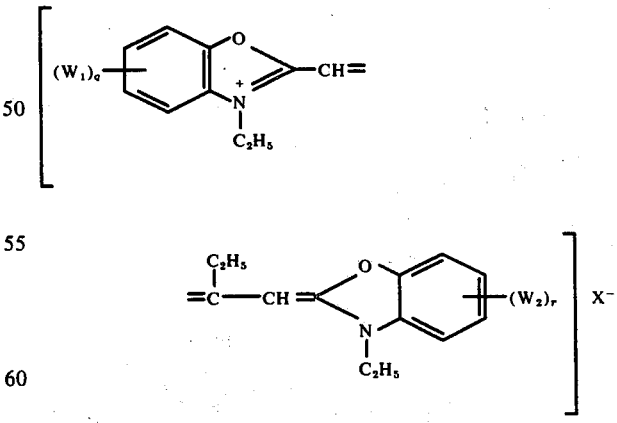

wherein $W_1$, $W_2$, $q$, $r$ and $X^-$ each has the same meaning as in general formula (II).

Formula (VI)

-continued

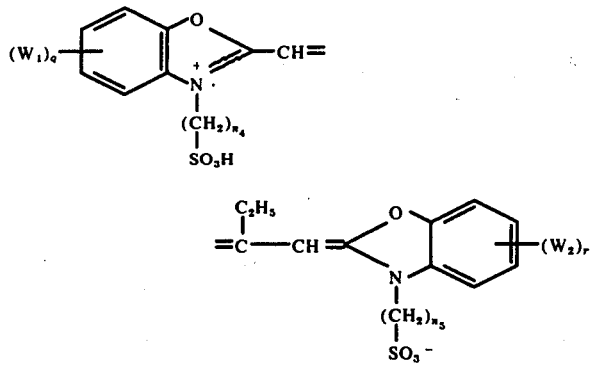

wherein $W_1$, $W_2$, $q$ and $r$ each has the same meaning as in general formula (II) and $n_4$ and $n_5$ each represents an integer of from 2 to 4.

Formula (VII)

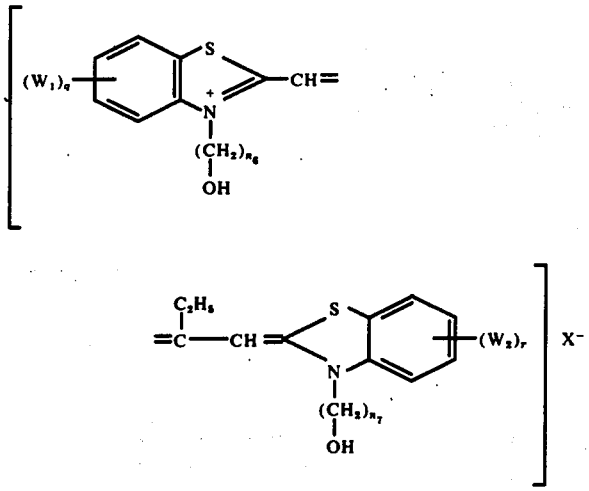

wherein $W_1$, $W_2$, $X^-$, $q$ and $r$ each has the same meaning as in general formula (II) and $n_6$ and $n_7$ each is an integer of from 2 to 4.

Formula (VIII)

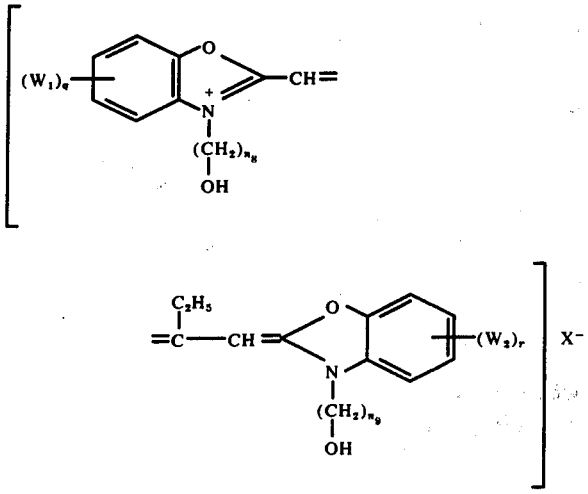

wherein $W_1$, $W_2$, $X^-$, $q$ and $r$ each has the same meaning as in general formula (II) and $n_8$ and $n_9$ each is an integer of from 2 to 4.

Formula (IX)

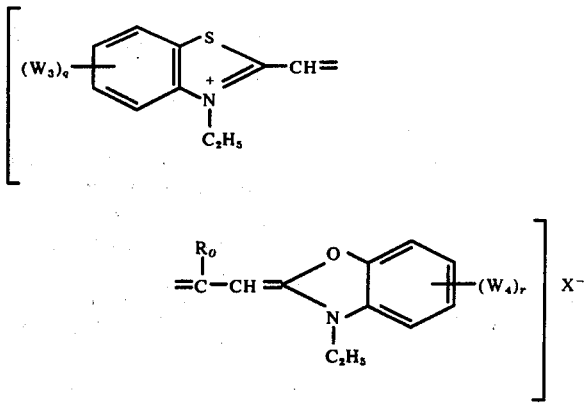

wherein $R_0$ and $X^-$ each has the meaning given in general formula (I), $W_3$ and $W_4$ each represents a hydrogen atom, an alkyl group having 1 to 4 carbon atoms, a monoaryl group which need not necessarily comprise 6 carbon atoms, a halogen atom, an alkoxy group having 1 to 4 carbon atoms, a carboxy group, a monoaralkyl group where the alkyl moiety most preferably comprises from 1 to 4 carbon atoms, a trifluoromethyl group, a hydroxy group, an alkoxycarbonyl group (the alkyl moiety of which has 1 to 4 carbon atoms) or a cyano group, and $q$ and $r$ each represents an integer of from 1 to 4.

Formula (X)

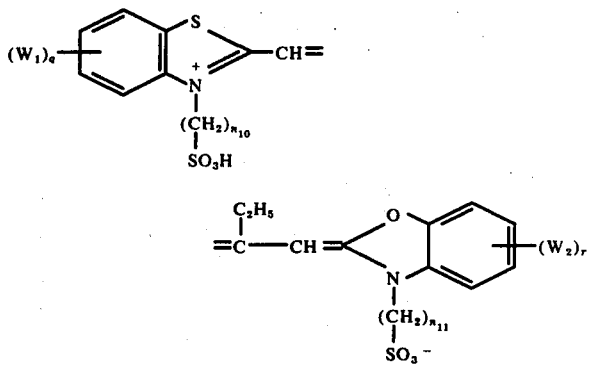

wherein $W_1$, $W_2$, $q$ and $r$ each has the same meaning as in general formula (II) and $n_{10}$ and $n_{11}$ each represents an integer of from 2 to 4.

Formula (XI)

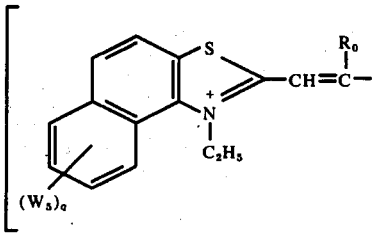

-continued

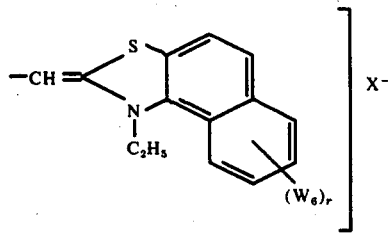

wherein $R_0$ and $X^-$ each has the meaning as in general formula (I), $W_5$ and $W_6$ each represents a hydrogen atom, an alkyl group having 1 to 4 carbon atoms, a monoaryl group which need not necessarily comprise 6 carbon atoms, a halogen atom, an alkoxy group having 1 to 4 carbon atoms, a carboxy group, a monoaralkyl group, most preferably where the alkyl moiety comprises from 1 to 4 carbon atoms, a trifluoromethyl group, a hydroxy group, an alkoxycarbonyl group (the alkyl moiety of which has 1 to 4 carbon atoms) or a cyano group, and $q$ and $r$ each represents an integer from 1 to 4.

Formula (XII)

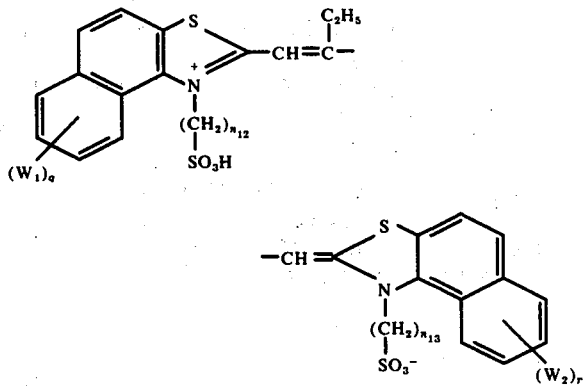

wherein $W_1$, $W_2$, $q$ and $r$ each has the same meaning as the corresponding one in the general formula (II), and $n_{12}$ and $n_{13}$ each represents an integer of from 1 to 4.

Formula (XIII)

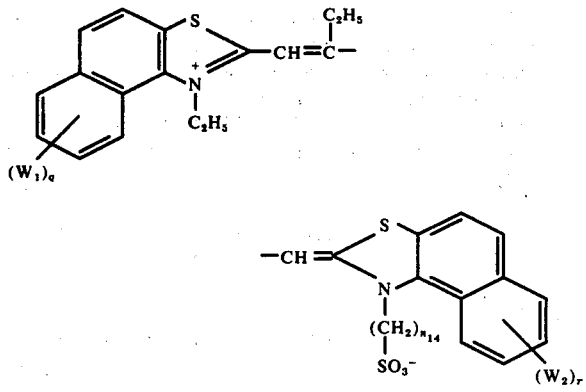

wherein $W_1$, $W_2$, $q$ and $r$ each has the meaning given in the general formula (II), and $n_{14}$ represents an integer of from 2 to 4.

Specific examples of dyes represented by general formula (II) include:

3,3'-diethyl-thiacarbocyanine iodide,
3,3'-diethyl-9-methyl-thiacarbocyanine iodide,
3,3'-diethyl-9-ethyl-thiacarbocyanine iodide,
5,5'-dichloro-3,3'-diethyl-9-ethyl-thiacarbocyanine iodide,
5,5'-dimethyl-3,3'-diethyl-9-ethyl-thiacarbocyanine iodide,
5,5'-dimethoxy-3,3'-diethyl-9-ethyl-thiacarbocyanine iodide,
5,5'-diphenyl-3,3'-diethyl-9-ethyl-thiacarboxyanine iodide, and the like. The corresponding chlorides, bromides, perchlorates or p-toluenesulfonates may also be used. As one skilled in the art will appreciate, the corresponding chlorides, bromides, perchlorates or p-toluene sulfonates may be used for the following dyes also; however, such are not recited in all instances for purposes of brevity.

Specific examples of dyes represented by general formula (III) include:

3,3'-disulfoalkyl-9-ethyl-thiacarbocyanine,
5,5'-dichloro-3,3'-disulfoalkyl-9-ethyl-thiacarbocyanine,
5,5'-dimethyl-3,3'-disulfoalkyl-9-ethyl-thiacarbocyanine,
5,5'-dimethoxy-3,3'-disulfoalkyl-9-ethyl-thiacarbocyanine,
5,5'-diphenyl-3,3'-disulfoalkyl-9-ethyl-thiacarbocyanine, and the like.

Specific examples of dyes represented by general formula (IV) include;

3-ethyl-3'-sulfoalkyl-9-ethyl-thiacarbocyanine,
5,5'-dichloro-3-ethyl-3'-sulfoalkyl-9-ethyl-thiacarbocyanine,
5,5'-dimethyl-3-ethyl-3'-sulfoalkyl-9-ethyl-thiacarbocyanine,
5,5'-dimethoxy-3-ethyl-3'-sulfoalkyl-9-ethyl-thiacarbocyanine,
5,5'-diphenyl-3-ethyl-3'-sulfoalkyl-9-ethyl-thiacarbocyanine, and the like.

Specific examples of dyes represented by general formula (V) include:

3,3'-diethyl-9-ethyl-oxacarbocyanine iodide,
5,5'-dichloro-3,3'-diethyl-9-ethyl-oxacarbocyanine iodide,
5,5'-dimethyl-3,3'-diethyl-9-ethyl-oxacarbocyanine iodide,
5,5'-dimethoxy-3,3'-diethyl-9-ethyl-oxacarbocyanine iodide,
5,5'-diphenyl-3,3'-diethyl-9-ethyl-oxacarbocyanine iodide, and the like. The corresponding chlorides, bromides, perchlorates or p-toluene sulfonates may also be used.

Specific examples of dyes represented by general formula (VI) include:

3,3'-disulfoalkyl-9-ethyl-oxacarbocyanine,
5,5'-dichloro-3,3'-disulfoalkyl-9-ethyl-oxacarbocyanine,
5,5'-dimethyl-3,3'-disulfoalkyl-9-ethyl-oxacarbocyanine,
5,5'-dimethoxy-3,3'-disulfoalkyl-9-ethyl-oxacarbocyanine,
5,5'-diphenyl-3,3'-disulfoalkyl-9-ethyl-oxacarbocyanine, and so on.

Specific examples of dyes represented by general formula (VII) include:

3,3'-dihydroxyalkyl-9-ethyl-thiacarbocyanine, 5,5'-dichloro-3,3'-dihydroxyalkyl-9-ethyl-thiacarbocyanine,
5,5'-dimethyl-3,3'-dihydroxyalkyl-9-ethyl-thiacarbocyanine,
5,5'-dimethoxy-3,3'-dihydroxyalkyl-9-ethyl-thiacarbocyanine,
5,5'-diphenyl-3,3'-dihydroxyalkyl-9-ethyl-thiacarbocyanine,
and the like.

Specific examples of dyes represented by general formula (VIII) include:
3,3'-dihydroxyalkyl-9-ethyl-oxacarbocyanine,
5,5'-dichloro-3,3'-dihydroxyalkyl-9-ethyl-oxacarbocyanine,
5,5'-dimethyl-3,3'-dihydroxyalkyl-9-ethyl-oxacarbocyanine,
5,5'-dimethoxy-3,3'-dihydroxyalkyl-9-ethyl-oxacarbocyanine,
5,5'-diphenyl-3,3'-dihydroxyalkyl-9-ethyl-oxacarbocyanine,
and the like.

Specific examples of dyes represented by general formula (IX) include:
3,3'-diethyl-thiaoxacarbocyanine iodide,
3,3'-diethyl-9-methyl-thiaoxacarbocyanine iodide,
3,3'-diethyl-9-ethyl-thiaoxacarbocyanine iodide,
5,5'-dichloro-3,3'-diethyl-9-ethyl-thiaoxacarbocyanine iodide,
5,5'-dimethyl-3,3'-diethyl-9-ethyl-thiaoxacarbocyanine iodide,
5,5'-dimethoxy-3,3'-diethyl-9-ethyl-thiaoxacarbocyanine iodide,
5,5'-diphenyl-3,3'-diethyl-9-ethyl-thiaoxacarbocyanine iodide,
and the like. The corresponding chlorides, bromides, perchlorates or p-toluene sulfonates may also be used.

Specific examples of dyes represented by general formula (X) include:
3,3'-disulfoalkyl-9-ethyl-thiaoxacarbocyanine,
5,5'-dichloro-3,3'-disulfoalkyl-9-ethyl-thiaoxacarbocyanine,
5,5'-dimethyl-3,3'-disulfoalkyl-9-ethyl-thiaoxacarbocyanine,
5,5'-dimethoxy-3,3'-disulfoalkyl-9-ethyl-thiaoxacarbocyanine,
5,5'-diphenyl-3,3'-disulfoalkyl-9-ethyl-thiaoxacarbocyanine,
and the like.

Specific examples of dyes represented by general formula (XI) include:
3,3'-diethyl-β-naphthothiacarbocyanine iodide,
3,3'-diethyl-9-methyl-β-naphthothiacarbocyanine iodide,
5,5'-dichloro-3,3'-diethyl-9-ethyl-β-naphthothiacarbocyanine iodide,
5,5-dimethyl-3,3'-diethyl-9-ethyl-β-naphthothiacarbocyanine iodide,
5,5'-dimethoxy-3,3'-diethyl-9-ethyl-β-naphthothiacarbocyanine iodide,
5,5'-diphenyl-3,3'-diethyl-9-ethyl-β-naphthothiacarbocyanine iodide, and the like. The corresponding chlorides, bromides, perchlorates or p-toluene sulfonates may also be used.

Specific examples of dyes represented by general formula (XII) include:
3,3'-disulfoalkyl-9-ethyl-β-naphthothiacarbocyanine,
5,5'-dichloro-3,3'-disulfoalkyl-9-ethyl-β-naphthothiacarbocyanine,
5,5'-dimethyl-3,3'-disulfoalkyl-9-ethyl-β-naphthothiacarbocyanine,
5,5'-dimethoxy-3,3'-disulfoalkyl-9-ethyl-β-naphthothiacarbocyanine,
5,5'-diphenyl-3,3'-disulfoalkyl-9-ethyl-β-naphthothiacarbocyanine,
and so on.

Specific examples of dyes represented by general formula (XIII) include:
3-ethyl-3'-sulfoalkyl-9-ethyl-β-naphthothiacarbocyanine,
5,5'-dichloro-3-ethyl-3'-sulfoalkyl-9-ethyl-β-naphthothiacarbocyanine,
5,5'-dimethyl-3-ethyl-3'-sulfoalkyl-9-ethyl-β-naphthothiacarbocyanine,
5,5'-dimethoxy-3-ethyl-3'-sulfoalkyl-9-ethyl-β-naphthothiacarbocyanine,
5,5-diphenyl-3-ethyl-3'-sulfoalkyl-9-ethyl-β-naphthothiacarbocyanine, and the like.

where the term "alkyl" is used in many of the above dyes, specific examples of such "alkyl" moieties are a propyl group or a butyl group.

Each of the above-described carbocyanine dyes can be used in an amount sufficient to effectively increase the sensitivity of an emulsion in the spectral sensitization wave-length region. The amount can be varied over a wide range depending upon the emulsion to be sensitized, but a preferred amount thereof ranges from about $10^{-6}$ mole to about $10^{-2}$ mole, particularly $10^{-5}$ mole to $10^{-3}$ mole, per mole of silver halide.

These sensitizing dyes can be added to emulsions in a conventional manner, e.g., the sensitizing dyes can be directly dispersed into emulsions or can be added to emulsions as a solution prepared by dissolving the dyes in a water-miscible organic solvent such as pyridine, methyl alcohol, ethyl alcohol, methyl cellosolve, acetone or the like (or a mixture thereof), or in water. In addition, ultrasonic waves can be used to assist in dissolving the dyes in the above-mentioned water-miscible solvents or in water. Moreover, as disclosed in U.S. Pat. No. 3,469,987, the dyes can be added to emulsions as a dispersion prepared by dispersing a solution of the dye in a volatile organic solvent into hydrophilic colloid, or as disclosed in Japanese Patent Publication No. 24185/71, water-insoluble dyes can be added to emulsions as a dispersion prepared by dispersing the dyes into a water-insoluble solvent without dissolving the same. Further, the dyes can be added to emulsions as a dispersion prepared by the acid dissolution dispersion method. Further, methods as disclosed in U.S. Pat. Nos. 2,912,345; 3,342,605; 2,996,287; 3,425,835 and so on may also be used.

Each of the benzotriazole compounds employed in the present invention is substituted with at least one halogen atom, and can form a slightly soluble silver salt by reacting with a silver ion, i.e., a silver salt which is less soluble than silver chloride. The halogenated benzotriazole compounds which can be used in the present invention have the following formula;

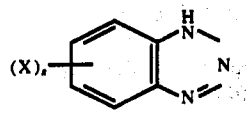

wherein X represents a chlorine, bromine or iodine atom, and *s* represents an integer from 1 to 4, and where when *s* equals 2, 3 or 4, the halogen atom substituents may be the same as or different from one another.

The quantity of the halogen substituted benzotriazole compound added to the emulsion should be sufficient to effectively increase the sensitivity of the emulsion. The consentration can be varied over a wide range depending on the emulsion to be sensitized. As a suggested concentration, from about 0.00001 mole to about 0.1 mole of halogenated benzotriazole per mole of silver halide can be added to obtain an effective increase in sensitivity. Especially good results are obtained when the halogenated benzotriazole is added in an amount of from about 0.0005 mole to about 0.05 mole per mole of silver halide. The molar ratio of the amount of the halogenated benzotriazole compound to that of the carbocyanine dye employed in the present invention is not limited to any particular range, but, in general, it ranges from about 1 : 1 to about 100 : 1.

Photographic emulsions which may be sensitized in the practice of the present invention can further contain sensitizing dyes other than the dyes represented by the general formula (I) to (XIII), or essentially colorless compounds having a supersensitization action within the concentration range wherein they will not harm the effects obtained by the practice of the present invention. For example, the photographic emulsion can contain pyrimidinyl amino group- or triazinylamino group-containing compounds as disclosed in U.S. Pat. Nos. 2,933,390; 3,511,664; 3,615,613; 3,615,632; 3,615,641 and the like: aromatic organic acid-formaldehyde condensation products as disclosed in British Pat. No. 1,137,580; azaindenes or cadmium salts such as a cadmium nitrate and cadmium sulfate.

The light-sensitive material comprising one or more photographic emulsions provided in accordance with the sensitization process of the present invention may further contain emulsion layers spectrally sensitized in a conventional manner and emulsion layers not spectrally sensitized. The coating order of the emulsions may be optionally varied in various ways as will be apparent to one skilled in the art.

The supersensitization action which can be attained by the combined use of one or more compounds having general formula (I) and one or more halogenated benzotriazoles in the practice of the present invention acts effectively to spectrally sensitize in the maximum sensitivity wave length region of from about 450 nm to about 750 nm. For example, a supersensitizing combination consisting of a thiacarbocyanine dye having general formula (II), (III), (IV), (VII), (XI), (XII) or (XIII), and a halogenated benzotriazole is suitable to increase the spectral sensitivity in the red wave length region, i.e., to provide a maximum sensitivity in the wave length region ranging from about 600 nm to about 700 nm. On the other hand, a supersensitizing combination consisting of an oxacarbocyanine dye represented by general formula (V), (VI) or (VIII) and a halogenated benzotriazole is suitable to increase the spectral sensitivity in the green wave length region, i.e., to provide a maximum sensitivity in the wave length region ranging from about 520 nm to about 600 nm.

The present invention may be carried out, for example, as follows:

Silver halide particles are produced in a conventional manner, e.g., by the reaction of a water soluble silver salt with a water soluble halide in a hydrophilic colloid solution (which provides a protective colloidal action). Chemical sensitizers are added to the resulting emulsion, and then the emulsion is subject to chemical ripening. The above-described carbocyanine dye is then added thereto and, furthermore, the halogenated benzotriazole is added thereto. The halogenated benzotriazole may be added before the conclusion of chemical ripening, if desired. It is most preferred that the benzotriazole be added after the addition of any dyes which are added, i.e., following chemical ripening typically the addition of dyes occurs, whereafter the benzotriazole is added.

The silver halides used in the photographic emulsions used in the present invention are conventional and include silver chloride, silver bromide, silver iodide or mixed silver halides thereof (or a solid solution thereof), and, preferably, are silver chlorobromide, silver iodobromide or silver chloroiodobromide, wherein the silver chloride content is not more than about 20 mole %, and the silver iodide content is less than about 4 mole %. Particularly preferred mixed silver halides are those containing less than 10 mole % silver chloride and not more than 1 mole % silver iodide.

The mean diameter of the silver halide grains employed (measured by, e.g., a projected area method or a number average method) is preferably is not more than about 4 microns, particularly from about 0.04 micron to about 1 micron. The grain size (the mean diameter of the grains) distribution can be narrow or wide. The mean diameter of the grains can be measured in a conventional manner, for example, as described in A. B. H. Trivelli & W. F. Smith "Empirical Relations between Sensitometric and Size-Frequency Characteristics in Photographic Emulsion Series", *Photographic Journal*, volume 79, page 330 to 338, (1949) where a detailed description of measurements according to the number average method is set forth.

The silver halide grains can be produced in a conventional manner, e.g., by a single jet method, a double jet method or a controlled double jet method.

The crystal structure of the silver halide grains may be homogeneous or of a layer structure having a shell-core structure, or may be of the conversion type structure as disclosed in British Pat. No. 635,841; U.S. Pat. No. 3,622.318; and the like. In addition, the grains may be either of the type in which latent images are mainly formed at the surface of the grains or of the internal latent image type wherein latent images are formed at the inner part of the grains. These photographic emulsions are described in detail in texts such as C.E.K. Mees "The Theory of the Photographic Process", MacMillan Publishers; Glafkides "Photographic Chemistry" Fountain Press Co., Ltd., and the like, and can be prepared by the conventional ammoniacal method, neutral method, acidic method and other various methods.

The silver halide grains employed to attain the objects of the present invention should, however, preferably have a regular structure such as octahedral, cubic, tetradecahedral, or a like structure, and it is more preferred for the silver halide photographic emulsions to contain the silver halide grains having such a regular structure in a proportion of at least 80 wt %, the shape of the balance of the grains being of no importance. Such structures and preparation methods of octahedral, cubic and tetradecahedral grains are well known, and for further details reference should be made to C.E.K. Mees & T. H. James, "The Theory of the Photographic Process" 3rd Edition, chapter 2, or, e.g., C. R. Berry & D. C. Skillmann "Precipitation of Twinned AgBr Crystals", *Photographic Science and Engineering*, volume 6, No. 2.).

The silver halide photographic emulsions employed in the present invention contain, in general, gelatin as a binder, but all of or some of the gelatin may be replaced by, e.g., gelatin derivatives, albumin, agar-agar, gum arabic, alginic acid, hydrophilic resins such as polyvinyl alcohol, polyvinyl pyrrolidone, acrylate copolymers, polyacrylamides, etc., or other materials which do not cause any harm to light-sensitive silver halides, such as cellulose derivatives. The gelatin derivatives which may be used as a binder in the present invention include the reaction products prepared from gelatin and reagents containing at least one functional group reactive to one of the functional groups in a gelatin molecule, i.e., an amino, an imino, a hydroxy or a carboxy groups, and graft polymers prepared by combining gelatin with molecular chains of other macromolecular compounds.

The silver halide photographic emulsions may be subjected to physical ripening or not so subjected, as desired. Water soluble salts are generally removed from the emulsions after the formation of the precipitated silver halide or after physical ripening. As means for removing water soluble salts from emulsions, conventional methods can be used, e.g., a noodle washing method or a flocculation method utilizing polyvalent anion-containing inorganic salts (e.g., ammonium sulfate), anionic surface active agents, polystyrene sulfonic acid, other anionic polymers or gelatin derivatives such as aliphatic- or aromaticacylated gelatins, etc.

The silver halide emulsions employed in the present invention can be chemically sensitized or not, as desired. Conventionally employed chemical sensitization techniques include sulfur sensitization, noble metal sensitization and reduction sensitization. Especially good results are obtained when sulfur sensitization is used. Typical sulfur sensitizing agents are disclosed, for example, in U.S. Pat. Nos. 1,574,944; 2,278,947; 2,410,689; 2,440,206; 3,501,313 and the like. Typical noble metal sensitizing agents are disclosed in, for example, U.S. Pat. Nos. 2,399,083; 2,540,085; 2,597,856; 2,597,915; 2,448,060; 2,540,086; 2,566,245; 2,566,263 and 2,598,079; and the like. Typical reduction sensitizing agents are disclosed in, for example, U.S. Pat. Nos. 2,487,850; 2,518,698; 2,521,925; 2,521,926; 2,694,637; 2,983,610; 3,201,254 and the like.

One or more surface active agents may be added to the photographic emulsion used in the present invention to function as a coating aid, and, in some cases, to assist in dispersing for emulsification, for sensitizing to improve photographic characteristics, to prevent electrification, to prevent adhesion, and the like.

Typical surface active agents include those compounds disclosed in U.S. Pat. Nos. 2,271,623; 2,240,472; 2,288,226; 2,739,891; 3,068,101; 3,158,484; 3,201,253; 3,210,191; 3,294,540; 3,415,649; 3,441,413; 3,442,654; 3,475,174; 3,545,974; 3,666,478; 3,507,660 and the like; British Pat. Nos. 1,198,450, etc.

If desired, the emulsions can be hardened in a conventional manner. Examples of hardeners include aldehyde series compounds such as formaldehyde, glutaraldehyde or the like; ketones such as diacetyl and cyclopentanedione; active halogen-containing compounds such as bis(2-chloroethyl urea), 2-hydroxy-4,6-dichloro-1,3,5-triazine and compounds as disclosed in U.S. Pat. Nos. 3,288,775; 2,732,303; 3,125,449, etc., British Pat. No. 1,167,207, etc. active olefin-containing compounds such as divinylsulfone, 5-acetyl-1,3-diacryloylhexahydro-1,3,5-triazine and those compounds disclosed in U.S. Pat. Nos. 3,635,718 and 3,232,763, in British Pat. No. 994,869 and the like; N-methylol compounds such as N-hydroxymethylphthalimide and those compounds disclosed in U.S. Pat. Nos. 2,732,316 and 2,586,168; isocyanates as disclosed in U.S. Pat. No. 3,103,437 and so on; aziridines as disclosed in U.S, Pat. Nos. 3,017,280 and 2,983,611; acid derivatives as disclosed in U.S. Pat. Nos. 2,725,294 and 2,725,295; carbodiimide series compounds as disclosed in U.S. Pat. No. 3,100,704 and so on; epoxy compounds as disclosed in U.S. Pat. No. 3,091,527 and so on; isooxazole series compounds as disclosed in U.S. Pat. Nos. 3,321,313 and 3,543,292; halogenocarboxyaldehydes such as mucochloric acid; dioxane derivatives such as dihydroxydioxane, dichlorodioxane, etc.; and inorganic hardeners such as chrom alum, zirconium sulfate, etc. In addition, precursors of the above-described materials such as addition products of an alkali metal bisulfite and an aldehyde, methylol derivatives of hydantoin, primary aliphatic nitroalcohols and the like may be included therein.

When used in a color photographic light-sensitive material, the silver halide emulsion used in the present invention contains a coupler, i.e., a compound capable of forming a dye by reacting with an oxidized primary aromatic amine developing agent. Such a coupler should be non-diffusible.

As yellow couplers, open-chain diketomethylene couplers are commonly employed. Examples of these couplers are disclosed in, for example, U.S. Pat. Nos. 3,341,331; 2,875,057 and 3,551,155; German Patent Application (OPI) No. 1,547,868; U.S. Pat. Nos. 3,265,506; 3,582,322 and 3,725,072; German Patent Application (OPI) No. 2,162,899; U.S. Pat. Nos. 3,369,895 and 3,408,194; German Patent Application (OPI) No. 2,057,941; 2,213,461; 2,219,917; 2,261,361 and 2,263,875; and so on.

As magenta couplers, 5-pyrazolone couplers are mainly employed, but indazolone and cyano acetyl couplers are also sometimes used. Examples of these couplers are disclosed in, for example, U.S. Pat. Nos. 2,439,098; 2,600,788; 3,062,653 and 3,558,319; British Pat. No. 956,261; U.S. Pat. Nos. 3,582,322; 3,615,506; 3,519,429; 3,311,476 and 3,419,391; Japanese Patent Applications Nos. 21454/73 and 56050/73; West German Pat. No. 1,810,464; Japanese Patent Publication No. 2016/69; Japanese Patent Application No. 45913/73; U.S. Pat. No. 2,983,608; and so on.

As cyan couplers, phenol or naphthol derivatives are mainly employed. Examples of such are disclosed in, for example, U.S. Pat. Nos. 2,369,929; 2,474,293; 2,698,794; 2,895,826; 3,311,476; 3,458,315; 3,560,212; 3,582,322; 3,591,383; 3,386,301; 2,434,272; 2,706,684; 3,034,892 and 3,583,971; German Patent Application (OPI) No. 2,163,811; Japanese Patent Publication No. 28836/70; Japanese Patent Application No. 33238/73; and so on.

In addition to the above, a development inhibitor-releasing coupler (DIR coupler) or a development inhibitorreleasing compound (DIR compound) can be also added to the emulsions when a color photographic light-sensitive material is involved. Examples of such are disclosed in, for example, U.S. Pat. Nos. 3,148,062; 3,227,554; 3,253,924; 3,617,291; 3,622,328 and 3,705,201; British Pat. No. 1,201,110; U.S. Pat. Nos. 3,297,445; 3,379,529 and 3,639,417; and so on.

The above-described couplers and the like can be added to only one emulsion layer singly or as a combination of two or more kinds thereof, or one kind of such a coupler can be added to two or more emulsion layers simultaneously in order to impart the desired characteristics to the light sensitive materials.

The photographic emulsion layers and other layers which can be employed in the present invention may further contain synthetic polymers, e.g., latex-like aqueous dispersions of vinyl polymers, and, particularly, compounds capable of increasing the dimensional stability of the photographic materials, either separately or as a mixture or as a combination with a hydrophilic water-permeable colloid. A large number of synthetic polymers can be so used, for example, as disclosed in U.S. Pat. Nos. 2,376,005; 2,739,137; 2,853,457; 3,062,674; 3,411,911; 3,488,708; 3,525,620; 3,635,715; 3,607,290 and 3,645,740: British Patents 1,186,699 and 1,307,373, and so on.

To the photographic emulsions various conventional compounds can be added to prevent a lowering in sensitivity and fogging in preparation, storage or treatment of the emulsions/photographic materials such as, for example, 4-hydroxy-6-methyl-1,3,3a,7-tetrazaindene, 3-methylbenzothiazole, 1-phenyl-5-mercaptotetrazole and other heterocyclic compounds, mercury-containing compounds and metal salts, etc. Specific examples of such compounds are described in C. E. K. Mees "The Theory of the Photographic Process" (3rd edition, 1966), page 344 to 349, and further in U.S. Pat. Nos. 1,758,576; 2,110,178; 2,131,038; 2,173,628; 2,697,040; 2,304,962; 2,324,123; 2,394,198; 2,444,605 to 8; 2,566,245; 2,694,716; 2,697,099; 2,708,162; 2,728,663 to 5; 2,476,536; 2,824,001; 2,843,491; 3,052,544; 3,137,577; 3,220,839; 3,226,231; 3,236,652; 3,251,691; 3,252,799; 3,287,135; 3,326,681; 3,420,668; 3,622,339; 2,933,388; 3,567,454 and 3,595,662; British Pat. No. 403,789; and so on.

The photographic emulsions of the present invention are applied to a conventional support such as a glass, metal, earthenware or a flexible support. The silver halide is optionally coated on the support at a coverage within the range of about 0.1 mg to about 3mg per square centimeters, but, the coating amount is not intended to be limited to this range.

Typical representative flexible supports include cellulose nitrate, cellulose acetate, cellulose acetate butyrate, cellulose acetate propionate, polystyrene, polyethylene terephthalate, polycarbonate, laminates thereof, thin glass films, paper and so on. Good results can be also obtained using as the support a baryta- or a polymer-coated or -laminated paper which is coated or laminated with an $\alpha$-olefin polymer having 2 to 10 carbon atoms such as polyethylene, polypropylene, an ethylene-butene copolymer, etc., or using plastic films the surfaces of which are matted to improve their adhesion to other macromolecular compounds and their printability, as disclosed in Japanese Patent Publication No. 19068/72.

The support may be transparent or opaque, as desired. Transparent supports can be colored by the addition of dyes or pigments, if desired. Thus, opaque supports include inherently opaque ones such as paper and transparent films rendered opaque by the addition of dyes or pigments such as titanium oxide, surface treated plastic films as discloed in Japanese Patent Publication No. 19068/72, paper or plastic films which completely shield light by the addition of carbon black or dyes or the like thereto, and so on. When the adhesion between a support and a photograhic emulsion layer is insufficient, a subbing layer adhesive to both the support and the emulsion layer may be coated therebetween. In order to further improve upon adhesiveness, the surface of the support can be pretreated in a conventional manner such as with a corona discharge, ultraviolet irradiation, flame treatment, or the like.

The supersensitizing technique in accordance with the present invention can be used for the preparation of a wide variety of silver halide photographic emulsions, for example, highly sensitive negative emulsions, positive emulsions, high speed reversal emulsions, emulsions used in X-ray recording materials for indirect photofluorography, high density emulsions, lithographic emulsions and so on. However, the present invention is not limited to these examples as the emulsions prepared according to the method of the present invention can be used for the production of many other silver halide photographic light sensitive materials. For example, such light-sensitive materials include common color and black-and-white negative sensitive materials, commonly used color and monochromatic reversal sensitive materials, color and monochromatic printing papers, lithographic sensitive materials, X-ray recording materials for indirect photofluorography, microphotograhic materials, negative and positive sensitive materials for color and black-and-white pictures, color and monochromatic diffusion transfer sensitive materials and so on. In short, the sensitive materials to which the method of the present invention may be applied are not limited to the above examples.

The present invention will now be illustrated in detail by reference to the following Examples.

Unless otherwise indicated in the following Examples all percentages are weight percentages and all processings were conducted at room temperature.

EXAMPLE 1

Primary Process

A photographic emulsion containing cubic silver bromide grains having a mean diameter of 0.7 micron was prepared by a conventional double jet method where both an aqueous solution of silver nitrate and an aqueous solution of potassium bromide were added at the same time to an aqueous gelatin solution with stirring to keep the silver ion concentration constant. The emulsion contained 0.38 mole of silver bromide and about 45 g of gelatin per 1 kg.

A 2,000 g portion of this emulsion was weighed out. 6.7 ml of a 0.63% aqueous solution of sodium thiosulfate was then added thereto and the emulsion placed on a 50° C thermostatic bath for one hour to ripen the same (sulfur sensitization).

50 g portions of this ripened emulsion were then weighed out, and 1 ml portions of a 0.1% methanol solution of 3,3'-dimethyl-O-methyl-thiacarbocyanine bromide (Dye-1) (optimum amount) and predetermined amounts (as shown in Table 1) of $5 \times 10^{-2}$ mole/l methanol solutions of 5-chlorobenzotriazole [Compound (1)] or 5-bromobenzotriazole [Compound (II)] were added to various portions to prepare various emulsion samples. Each of the thus finished emulsion portions was applied to a cellulose triacetate transparent film having a subbing layer thereon to provide a dry thickness of 4 microns and then dried. Light sensitive material samples were obtained.

Each of these film samples were subjected to optical exposure using a tungsten lamp (color temperature of 2854° K; 1,000 lux at the element surface; total distance between the tungsten lamp and the element being 105.3 cm) covered by a minus blue filter for ten seconds. As the minus blue filter, glass filter V052 was used (transmitting light having wavelengths longer than 490 nm; i.e. at a wavelength of 500 nm about 10% of the light is transmitted through this filter, at a wavelength of 520 nm about 73% of light is transmitted, and at the wavelengths longer than 540 nm 80 to 90% of the light is transmitted; made by Tokyo Shibaura Electric Co., Ltd.).

The thus exposed samples were each developed at 20° C for 10 minutes using a Metol-ascorbic acid developer (2.5 g of Metol, 10 g of ascorbic acid, 1.0 g of potassium bromide and 35.0 g of Nabox, water added to make the total volume 1 liter, pH adjusted to pH=9.8 with sodium hydroxide).

Following development, the developed samples were fixed at 20° C for 10 minutes using the fixing solution having the following composition:

| Fixing Solution | |
|---|---|
| Sodium thiosulfate (pentahydrate) | 300 g |
| Sodium sulfite (anhydrous) | 15 g |
| Glacial acetic acid | 12 cc |
| Nabox (sodium metaborate) | 12 g |
| Potassium alum | 20 g |
| Water to make | 1 liter |

The density of the thus obtained images was measured using an automatic recording densitometer (made by Fuji Photo Film Co., Ltd.). The photographic sensitivity was expressed in terms of the reciprocal of the exposure amount necessary to provide a photographic density of fog + 0.1. The results are shown in Table 1 were "minus blue" sensitivity represents the relative sensitivity value obtained using the "minus blue" filter in the spectrally sensitized wavelength region of the samples.

Table 1

| Test No. | Dye 1 (millimol/ mol AgBr) | Compound (I) (millimol/ mol AgBr) | Compound (II) (millimol/ mol AgBr | "Minus blue" sensitivity (relative value) |
|---|---|---|---|---|
| | (Emulsions containing cubic silver bromide grains having a mean diameter of 0.7 micron) | | | |
| 1 (comparison) | 0.12 | 0 | 0 | 100 (standard) |
| 2 | 0.12 | 0.7 | 0 | 174 |
| | 0.12 | 2.7 | 0 | 141 |
| 3 | 0.12 | 0 | 0.7 | 245 |
| | 0.12 | 0 | 2.7 | 234 |
| | 0.12 | 0 | 10.7 | 170 |

As can be seen from the sensitivity values in Table 1, the "minus blue" sensitivity of the photographic emulsion color sensitized by the addition of a dye was remarkably increased by the further addition of Compound (I) or Compound (II).

Even when a photographic emulsion containing a combination of Dye 1 and Compound (I) or Compound (II) was exposed for a very short time (e.g., 0.01 second), or developed using D-76, D-85 or DK-50 as a developing solution, an increase in sensitivity was found in a manner similar to the above.

Secondary Process

Moreover, 5.7 wt % of a coupler having the following formula:

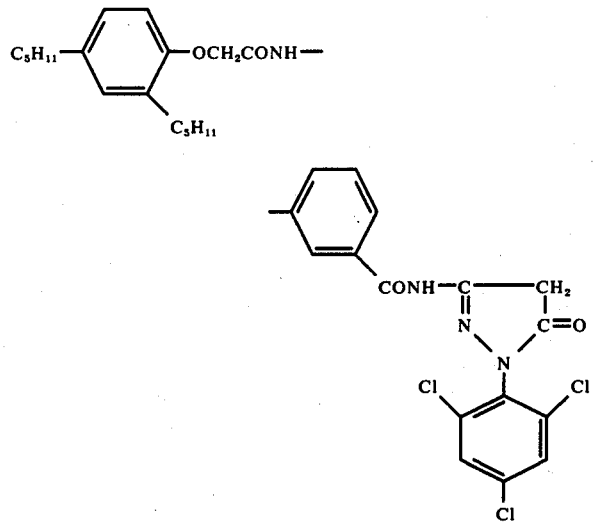

was added to the above-described emulsion and the thus obtained emulsions coated on a film base and exposed as above, whereafter the samples were developed using a color developer described below containing the developing agent having the following formula:

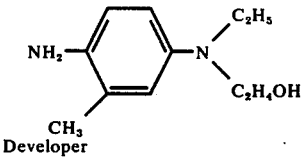

| Color Developer | |
|---|---|
| Water | 800 cc |
| Nitrilotriacetic Acid | 0.72 g |
| Potassium metabisulfite | 3.38 g |
| Sodium sulfate | 0.15 g |

-continued

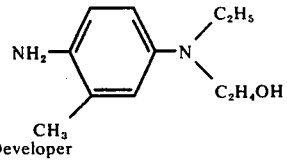

Color Developer

| | |
|---|---|
| Potassium carbonate | 31.9 g |
| Sodium bicarbonate | 3.82 g |
| Potassium hydroxide | 1.60 g |
| Sodium bromide | 1.21 g |
| Potassium chloride | 0.32 g |
| Developing agent of the formula | 4.33 g |
| Hydroxyamine sulfate | 2.43 g |
| Water to make | 1 liter |
| 37° C, 2 min. 45 sec. | |

The above components were mixed with 800 cc of water to form a homogeneous solution, whereafter water was added to make 1 liter.

It was confirmed that an increase in sensitivity caused by the incorporation of the combination of Dye 1 and Compound (I) or Compound (II) in the emulsion was attained.

EXAMPLE 2

Emulsions were prepared as in Example 1 except 5,5'-dichloro-3,3'-diethyl-9-ethyl-thiacarbocyanine p-toluene sulfonate (Dye 2) was added to the emulsion instead of Dye 1 used in Example 1 and only Compound (II) was employed as a benzotriazole compound. All other parameters were identical. Each of the emulsion samples was coated, exposed, developed and examined, all as in Example 1 under the heading Primary Process. The resulting sensitivity values are shown in Table 2.

Table 2

| Test No. | Dye 2 (millimol/ mol AgBr) | Compound (II) (millimol/ mol AgBr) | "Minus blue" sensitivity (relative value) |
|---|---|---|---|
| 4 (Comparison) | 0.12 | 0 | 100 (Standard) |
| 5 | 0.12 | 0.7 | 105 |
| | 0.12 | 2.7 | 115 |
| | 0.12 | 10.7 | 170 |

As is apparent from Table 2, the sensitivity of the emulsions containing cubic silver bromide grains remarkably increased due to the combination of Dye 2 and Compound (II) therein, as compared with Dye 2 alone.

EXAMPLE 3

Emulsions were prepared as in Example 2 except 5,5'-dichloro-3,3'-disulfopropyl-9-ethyl-thiacarbocyanine (Dye 3) was added to the emulsion instead of Dye 2 used in Example 2. All other parameters were the same. Each of these emulsion samples was subjected to coating, exposure and development and examined, all as in Example 2. The resulting sensitivity values are shown in Table 3.

Table 3

| Test No. | Dye 3 (millimol/ mol AgBr) | Compound (II) (millimol/ mol AgBr) | "Minus blue" sensitivity (relative value) |
|---|---|---|---|
| 6 (Comparison) | 0.12 | 0 | 100 (Standard) |
| | 0.23 | 0 | 87 |
| 7 | 0.12 | 0.7 | 110 |

Table 3-continued

| Test No. | Dye 3 (millimol/ mol AgBr) | Compound (II) (millimol/ mol AgBr) | "Minus blue" sensitivity (relative value) |
|---|---|---|---|
| | 0.23 | 0.7 | 91 |
| | 0.12 | 2.7 | 162 |
| | 0.23 | 2.7 | 142 |
| | 0.12 | 10.7 | 148 |
| | 0.23 | 10.7 | 174 |

As is apparent from the sensitivity values shown in Table 3, the cubic silver bromide emulsions remarkably increased in "minus blue" sensitivity due to the presence of the combination of Dye 3 and Compound (II) therein, as compared with the use of Dye 3 alone.

EXAMPLE 4

Emulsions were prepared in the same manner as in Example 2 except 5,5'-diphenyl-3,3'-diethyl-9-ethyl-oxacarbocyanine iodide (Dye 4) was added instead of Dye 2. Each emulsion sample was coated, exposed, developed and examined all as in Example 2. The resulting sensitivity values are shown in Table 4.

Table 4

| Test No. | Dye 4 (miilimol/ mol AgBr) | Compound (II) (millimol/ mol AgBr) | "Minus blue" sensitivity (relative value) |
|---|---|---|---|
| 8 (Comparison) | 0.12 | 0. | 100 (Standard) |
| | 0.23 | 0 | 98 |
| | 0.46 | 0 | 53 |
| 9 | 0.12 | 0.7 | 118 |
| | 0.23 | 0.7 | 128 |
| | 0.46 | 0.7 | 95 |
| 10 | 0.12 | 2.7 | 107 |
| | 0.23 | 2.7 | 162 |
| | 0.46 | 2.7 | 191 |
| 11 | 0.12 | 10.7 | 110 |
| | 0.23 | 10.7 | 148 |
| | 0.46 | 10.7 | 200 |

It is apparently from the sensitivity values in Table 4, a remarkable increase in the sensitivity in the spectral sensitization region was attained by the use of a combination of Dye 4 and Compound (II) in the emulsion containing cubic silver bromide grains having a mean diameter of 0.7 micron, as compared with the use of Dye 4 alone.

EXAMPLE 5

Emulsions were prepared in the same manner as in Example 2 except 5,5'-dichloro-3,3'-disulfopropyl-9-ethyloxacarbocyanine (Dye 5) was added thereto instead of Dye 2. Each of emulsion sample was coated, exposed, developed, and examined, all as in Example 2. The resulting sensitivity values are shown in Table 5.

Table 5

| Test No. | Dye 5 (millimol/ mol/ AgBr) | Compound (II) (millimol/ mol AgBr) | "Minus blue" sensitivity (relative value) |
|---|---|---|---|
| 12 | 0.46 | 0 | 100 (Standard) |
| | 0.46 | 0.7 | 288 |
| | 0.46 | 2.7 | 4.26 |
| | 0.46 | 10.7 | 850 |

As is apparent from values sensitivity values shown in Table 5, a remarkable increase in the sensitivity in the spectral sensitization range was attained by the combined use of Dye 5 and Compound (II) with an emulsion containing cubic silver bromide grains having a mean diameter of 0.7 micron, as compared with the use of Dye (5) alone.

COMPARISON 1

Emulsions were prepared in the same manner as in Example 2 except one of the following dyes (Dyes 6 to 9) was added to each different Sample instead of Dye 2.

Dye 6: 1,1'-diethyl-2,2'-quinocyanine iodide.

Dye 7:

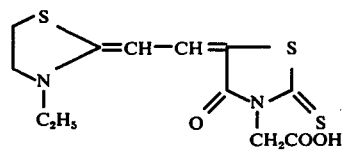

Dye 8:

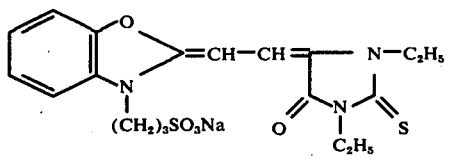

Dye 9: Erythrosine.

Each of these emulsion samples received was then coated, exposed, developed and examined, all as in Example 2. The results are shown in Table 6.

Table 6

| Test No. | Dye No. | Dye-Amount Used (millimol/mol AgBr) | Compound (II) millimol/mol AgBr) | "Minus Blue" Sensitivity (relative value) |
|---|---|---|---|---|
| 13 | 6 | 0.23 | 0 | 100 (Standard) |
| | | 0.23 | 0.7 | 31 |
| | | 0.23 | 2.7 | 36 |
| | | 0.23 | 10.7 | 36 |
| 14 | 7 | 0.06 | 0 | 100 (Standard) |
| | | 0.06 | 2.7 | 74 |
| | | 0.06 | 10.7 | 58 |
| 15 | 8 | 0.23 | 0 | 100 (Standard) |
| | | 0.23 | 0.7 | 58 |
| | | 0.23 | 2.7 | 45 |
| 16 | 9 | 0.46 | 0 | 100 (Standard) |
| | | 0.46 | 0.7 | 68 |
| | | 0.46 | 2.7 | 35 |
| | | 0.46 | 10.7 | 26 |

It can be seen from Table 6 that the combined use of Dye 6 (a monomethinecyanine dye) Dye 7 or Dye 8 (merocyanine dyes) or Dye 9 (an acidic dye) with Compound (II)(a benzotriazole compound) did not increase "minus blue" sensitivity, i.e., the sensitivity in the spectral sensitization region.

Moreover, when 5,5',6,6'-tetrachloro-1,1'-diethyl-3,3'-sulfopropyl-benzimidacarbocyanine was employed together with Compound (II) instead of Dye 2 the increase in "minus blue" sensitivity attributable to Compound (II) was found to be small. Similar results were obtained with Compound (I).

It can be concluded from these results that the combination of a halogenated benzotriazole with a cyanine dye represented by general formula (I), particularly with the cyanine dyes furthermore containing as hetero atoms sulfur or oxygen atoms in addition to nitrogen atoms, effectively show supersensitization.

EXAMPLE 6

An emulsion containing octahedral silver bromide grains having a mean diameter of 0.7 micron was prepared (via the double jet method) instead of the emulsion containing cubic silver bromide grains having a mean diameter of 0.7 micron prepared in Example 1; the emulsion was otherwise the same as that prepared in Example 1.

A 2,000 g portion of this emulsion was weighed out and 5.3 ml of a 0.06% by weight aqueous solution of sodium thiosulfate added thereto, whereafter the emulsion was placed in a 50° C thermostatic bath for 60 minutes to ripen the same. Dye 1 and Compound (I) or Compound (II) were added to different 50 g samples of the thus finished emulsion, and thereafter coated, etc., as in Example 1. The results obtained are shown in Table 7.

Table 7

| Test No. | (Emulsions containing octahedral silver bromide grains having a mean diameter of 0.7 micron) Dye 1 (millimol/mol AgBr) | Compound (I) (millimol/mol AgBr) | Compound (II) (millimol/mol AgBr) | "Minus Blue" Sensitivity (relative value) |
|---|---|---|---|---|
| 20 (Comparison) | 0.23 | 0 | 0 | 100 (Standard) |
| 21 | 0.23 | 0.7 | 0 | 141 |
| | 0.23 | 2.7 | 0 | 135 |
| 22 | 0.23 | 0 | 0.7 | 166 |
| | 0.23 | 0 | 2.7 | 204 |
| | 0.23 | 0 | 10.7 | 245 |

It can be seen from Table 7 that in the case of the octahedral silver bromide emulsion a remarkable increase in the sensitivity in the spectral sensitization distribution range was also attained by the combination of Dye 1 and Compound (I) or Compound (II) incorporated therein.

EXAMPLE 7

Following the procedure of Example 6 except for changing the grains to tabular silver bromide grains of a mean diameter (in the flat plane) of 1.1 micron instead of the emulsion containing octahedral silver bromide grains having a mean diameter of 0.7 micron used in Example 6, the combination of Dye 1 with Compound (I) or Compound (II) provided a rather small increase in sensitivity as compared to Example 6.

It can be seen from the results obtained in Examples 1 to 6 and 7 that in photographic emulsions containing silver halide grains having a regular crystal form such as an octahedral and cubic form, which are well known to be representative forms in the art of crystallography, a combination of a trimethinecyanine dye and a halogenated benzotriazole is effective to increase the sensitivity in the spectral sensitization region, while these combinations provided only a small effect upon photographic emulsions containing silver halide grains having an irregular crystal form, such as a tabular form.

EXAMPLE 8

Emulsions were prepared as in Example 1 except for containing cubic silver iodobromide grains having a mean diameter of 0.56 micron (containing 1 mole % of silver iodide). A 2,000 g portion of this emulsion was weighed out and 168 ml of a 0.06% by weight aqueous solution of sodium thiosulfate added thereto, whereafter it was placed in a 50° thermostatic bath for 60 minutes for ripening. Dye 1 and Compound (II) were added thereto as in Example 1 whereafter coating, etc., as in Example 1 were carried out to obtain the results shown in Table 8.

Table 8

(Emulsions containing cubic silver iodobromide grains having a mean diameter of 0.56 micron)

| Test No. | Dye 1 (millimol/ mol AgBr) | Compound (II) (millimol/ mol AgBr) | "Minus Blue" Sensitivity (Relative value) |
|---|---|---|---|
| 23 (Comparison) | 0.23 | 0 | 100 (Standard) |
| 24 | 0.23 | 0.7 | 118 |
| | 0.23 | 2.7 | 112 |

It can be seen from Table 8 that with sulfur sensitized emulsions containing cubic silver iodobromide grains a larger spectral sensitization effect was attained using the combination of Dye 1 and Compound (II) as compared to the use of Dye 1 alone.

The procedure of Example 8 was duplicated except for using an emulsion containing cubic silver iodobromide grains having a mean diameter of 0.5 micron (containing 3 mole % of silver iodide). While an increase in spectral sensitivity attributable to the combined use of Dye 1 and Compound (II) was observed, the magnitude of the increase was small. It was then concluded that the combination of a carbocyanine sensitizing dye represented by general formula (I) and a halogenated benzotriazole had a comparatively small effect on a silver halide emulsion containing silver iodide in a comparatively large quantity.

EXAMPLE 9

An emulsion was prepared as in Example 1 except for containing cubic silver chloride grains having a mean diameter of 0.3 micron. 14 ml of a 0.06% by weight aqueous solution of sodium thiosulfate was added to a 2,000 g portion of this emulsion which was then placed in a 50° C thermostatic bath for 60 minutes for ripening. Dye 1 and Compound (II) were further added thereto, whereafter the procedure of Example 1 was followed. The results obtained are shown in Table 9.

Table 9

(Emulsion containing cubic silver chloride grains having a mean diameter of 0.3 micron)

| Test No. | Dye 1 (millimol/ mol AgCl) | Compound (II) (millimol/ mol AgCl) | "Minus Blue" Sensitivity (Relative Value) |
|---|---|---|---|
| 25 (Comparison) | 0.23 | 0 | 100 (Standard) |
| 26 | 0.23 | 0.7 | 126 |
| | 0.23 | 2.7 | 108 |

It can be seen from Table 9 that with a cubic silver chloride emulsion the combination of Dye 1 and Compound (II) produced a larger spectral sensitization effect than the use of Dye 1 alone.

EXAMPLE 10

To a 2,000 g portion of the emulsion prepared in Example 1 there was added 3.3 ml of a 1% by weight aqueous solution of sodium thiosulfate (pentahydrate), whereafter sulfur sensitization, coating, etc., as in Example 2 were carried out using 3,3'-diethyl-thiacarbocyanine bromide (Dye 6) and Compound (II). The results are shown in Table 10.

Table 10

| Test No. | Dye 6 (millimol/ mol AgBr) | Compound (II) (millimol/ mol AgBr) | "Minus Blue" Sensitivity (Relative Value) |
|---|---|---|---|
| 27 (Comparison) | 0.012 | 0 | 100 (Standard) |
| | 0.024 | 0 | 65 |
| 28 | 0.012 | 2.7 | 214 |
| | 0.024 | 2.7 | 191 |
| | 0.012 | 10.7 | 324 |
| | 0.024 | 10.7 | 407 |

It can be seen from the sensitivity values of Table 10 that a remarkable increase in sensitivity was attained by the use of the combination of Dye 6 and Compound (II) in an emulsion containing cubic silver bromide grains having a mean diameter of 0.7 micron, as compared with the use of Dye 6 alone.

EXAMPLE 11

To individual emulsion portions prepared and sulfur sensitized as in Example 10, 3,3'-diethyl-6,7,6',7'-dibenzothiadicarbocyanine iodide (Dye 7) 3,3'-diethyl-6,7-benzothiatricarbocyanine iodide (Dye 8) and 3,3'-diethylthiatricarbocyanine bromide (Dye 9) was each added, whereafter the procedure of Example 2 was carried out. The resulting sensitivity values are shown in Table 11.

Table 11

| Test No. | Dye No. | Dye Amount Used (millimol/mol AgBr) | Compound (II) (millimol/ mol AgBr) | "Minus Blue" Sensitivity (Relative Value) |
|---|---|---|---|---|
| 29 (Comparison) | 7 | 0.009 | 0 | 100 (Standard) |
| | | 0.018 | 0 | 71 |
| 30 | 7 | 0.009 | 2.7 | 155 |
| | | 0.018 | 2.7 | 138 |
| | | 0.009 | 10.7 | 148 |
| | | 0.018 | 10.7 | 186 |
| 31 (Comparison) | 8 | 0.019 | 0 | 100 (Standard) |
| 32 | 8 | 0.019 | 2.7 | 257 |
| 33 | 9 | 0.023 | 0 | 100 (Standard) |
| 34 | 9 | 0.023 | 2.7 | 316 |

It can be seen from Table 11 that a remarkable increase in sensitivity in the spectral sensitization region was achieved by the use of a combination of Dye 7, Dye 8 or Dye 9 with Compound (II) in the respective emulsion portions containing cubic silver bromide grains, as compared with the use of these dyes alone.

While the invention has been described in detail and with reference to speciric embodiments thereof, it will be apparent to one skilled in the art that various changes and modifications can be made therein without departing from the spirit and scope thereof.

What is claimed is:

1. A silver halide photographic emulsion supersensitized by a combination of 1. at least one cyanine sensitizing dye containing therein two 5- and/or 6-membered nitrogen-containing heterocyclic nuclei, which may be the same as or different from each other, and which are attached, through a conjugated methine chain consisting of three, five or seven methine groups, to each other, wherein the cyanine sensitizing dye has the following General Formula (I), which represents a resonance structure:

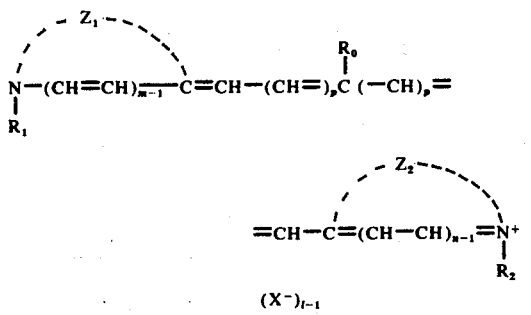

(I)

wherein $l$, $m$ and $n$ each represents 1 or 2, $p$ represents 0, 1 or 2, $R_0$ represents hydrogen atom, an alkyl group, a carboxyalkyl group, a hydroxyalkyl group, an alkoxy group, an alkylthio group, an aralkyl group or an aryl group, and $X^-$ represents an inorganic or organic acid anion, where the dye forms an intermolecular salt when $l$ is 1, $R_1$ and $R_2$ each represents an aliphatic group, which may be saturated or unsaturated, or an aryl group, an $Z_1$ and $Z_2$ each represents a non-metallic atomic group necessary to complete a 5- or 6-membered nitrogen-containing heterocyclic ring; and 2. at least one benzotriazole compound substituted with at least one halogen atom having the following formula;

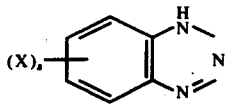

wherein X represents a chlorine, bromine or iodine atom, and s represents an integer from 1 to 4, and where when $s$ equals 2, 3 or 4, the halogen atom substituents may be the same as or different from one another, both (1) and (2) being present in supersensitizing amounts.

2. The silver halide emulsion as defined in claim 1 wherein not less than 80% by weight of the silver halide grains in the silver halide emulsion have a regular crystal form.

3. The silver halide emulsion as defined in claim 1 wherein said silver halide is a mixture of silver bromide, silver chloride and silver iodide, the quantity of chloride being less than 20 mole % and the quantity of iodide being less than 4 mole %.

4. The silver halide emulsion as defined in claim 1 wherein the silver halide grains comprising said emulsion are a mixture containing less than 10 mole % of silver chloride and less than 1 mole % of silver iodide.

5. The silver halide emulsion as defined in claim 1 wherein the silver halide grains comprising the emulsion are silver iodobromide containing less than 1 mole % of silver iodide, or silver bromide.

6. The silver halide emulsion as defined in claim 1 wherein the mean diameter of the silver halide grains comprising said emulsion is not more than about 1 micron.

7. The silver halide emulsion as defined in claim 1, wherein said at least one cyanine sensitizing dye has the formula

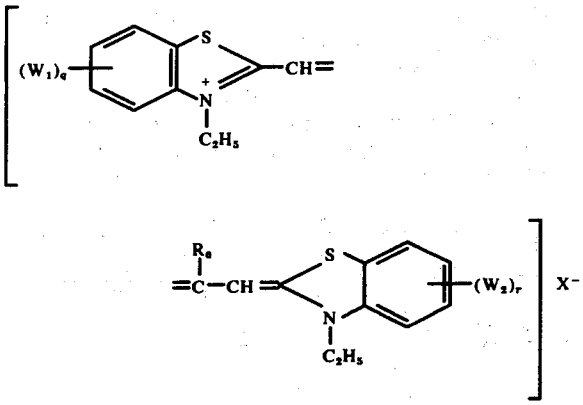

wherein $R_0$ and $X^-$ have the same meaning as in general formula (I), $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, an $q$ and $r$ each represents an integer ranging from 1 to 4.

8. The silver halide emulsion as defined in claim 1, wherein said at least one cyanine sensitizing dye has the formula

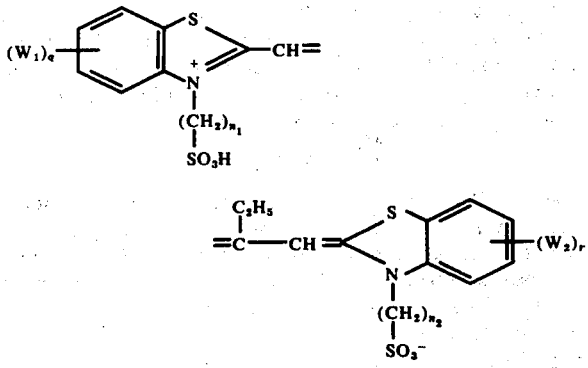

wherein $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, $q$ and $r$ each represents an integer ranging from 1 to 4 and $n_1$ and $n_2$ each is an integer of 2 to 4.

9. The silver halide emulsion as defined in claim 1, wherein said at least one cyanine sensitizing dye has the formula

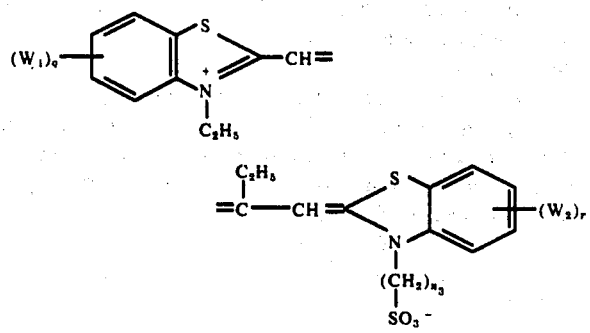

wherein, $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, $q$ and $r$ each represents an integer ranging from 1 to 4 and $n_3$ represents an integer of from 2 to 4.

10. The silver halide emulsion as defined in claim 1, wherein said at least one cyanine sensitizing dye has the formula

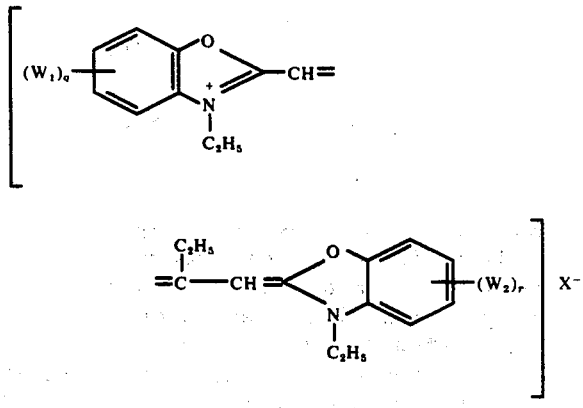

wherein $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, $q$ and $r$ each represents an integer ranging from 1 to 4 and $X^-$ has the same meaning as in General Formula (I).

11. The silver halide emulsion as defined in claim 1, wherein said at least one cyanine sensitizing dye has the formula

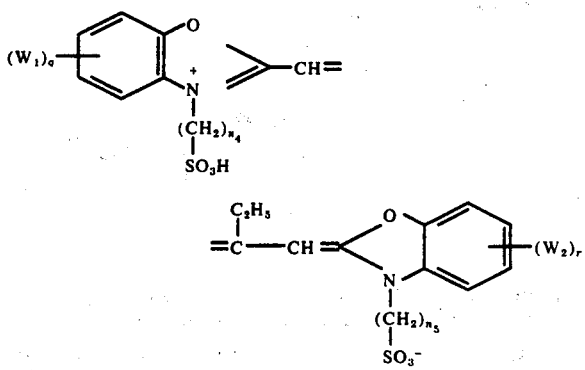

wherein $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, $q$ and $r$ each represents an integer ranging from 1 to 4 and $n_4$ and $n_5$ each represents an integer of from 2 to 4.

12. The silver halide emulsion as defined in claim 1, wherein said at least one cyanine sensitizing dye has the formula

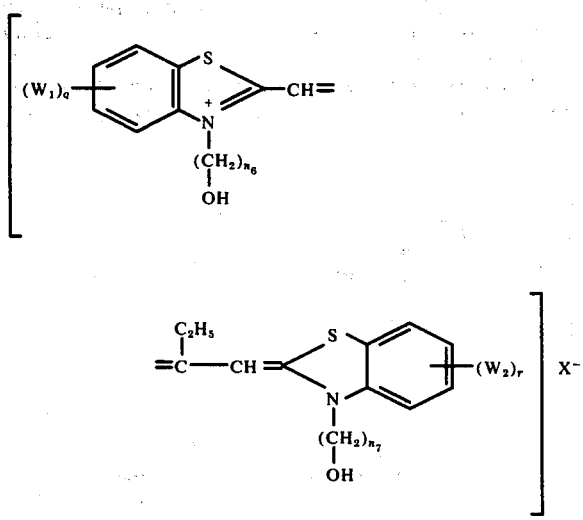

wherein $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, $q$ and $r$ each represents an integer ranging from 1 to 4 and $X^-$ is as defined in General Formula (I) and $n_6$ and $n_7$ each is an integer of from 2 to 4.

13. The silver halide emulsion as defined in claim 1, wherein said at least one cyanine sensitizing dye has the formula

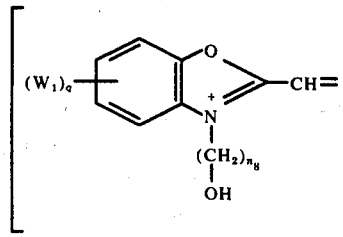

-continued

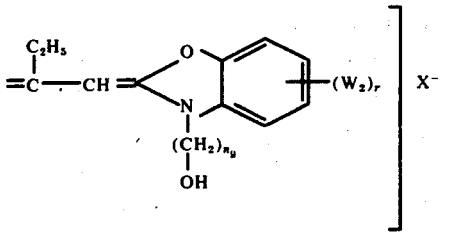

wherein $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, $q$ and $r$ each represents an integer ranging from 1 to 4, $X^-$ has the same meaning as in General Formula (I) and $n_8$ and $n_9$ each is an integer of from 2 to 4.

14. The silver halide emulsion as defined in claim 1, wherein said at least one cyanine sensitizing dye has the formula

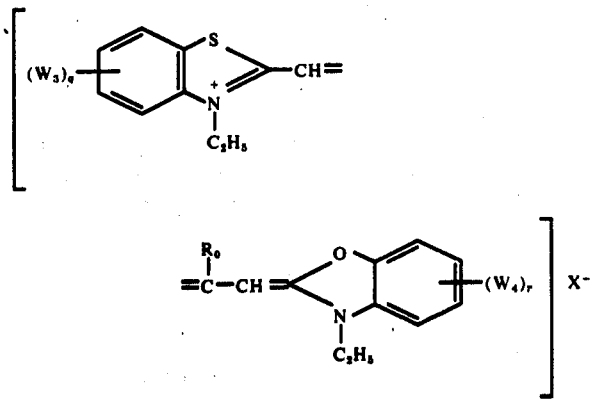

wherein $R_0$ and X each has the same meaning as in General formula (I), $W_3$ and $W_4$ each represents hydrogen atom, an alkyl group having 1 to 4 carbon atoms, a monoaryl group, a halogen atom, an alkoxy group having 1 to 4 carbon atoms, a carboxy group, a monoaralkyl group, a trifluoromethyl group, a hydroxy group, an alkoxycarbonyl group the alkyl moiety of which has 1 to 4 carbon atoms, or a cyano group, and q and r each represent an integer of from 1 to 4.

15. The silver halide emulsion as defined in claim 1, wherein said at least one cyanine sensitizing dye has the formula

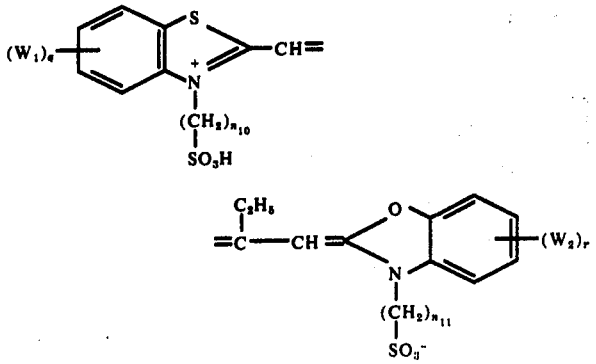

wherein $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl goup, a hydroxy group, an alkoxycarbonyl group where the alkyl moiety has 1 to 4 carbon atoms, or a cyano group, $q$ and $r$ each represents an integer ranging from 1 to 4 and $n_{10}$ and $n_{11}$ each represent an integer of from 2 to 4.

16. The silver halide emulsion as defined in claim 1, wherein said at least one cyanine sensitizing dye has the formula

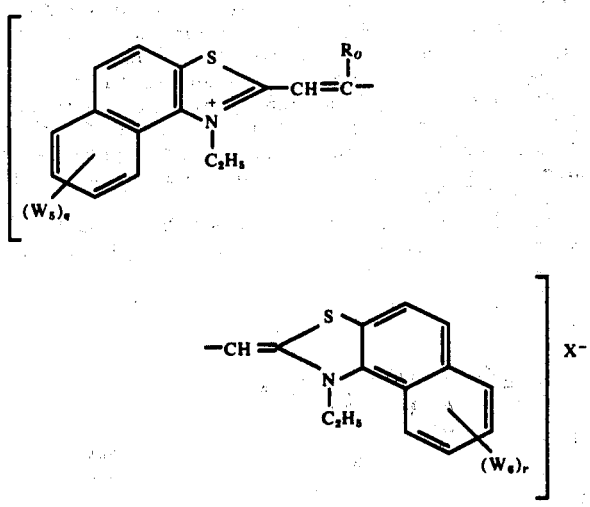

wherein $R_0$ and $X^-$ each has the meaning as in General Formula (I), $W_5$ and $W_6$ each represents a hydrogen atom, an alkyl group having 1 to 4 carbon atoms, a monoaryl group, a halogen atom, an alkoxy group having 1 to 4 carbon atoms, a carboxy group, a monoaralkyl group, a trifluoromethyl group, a hydroxy group, an alkoxycarbonyl group the alkyl moiety of which has 1 to 4 carbon atoms, or a cyano group, and $q$ and $r$ each represents an integer ranging from 1 to 4.

17. The silver halide emulsion as defined in claim 1, wherein said at least one cyanine sensitizing dye has the formula

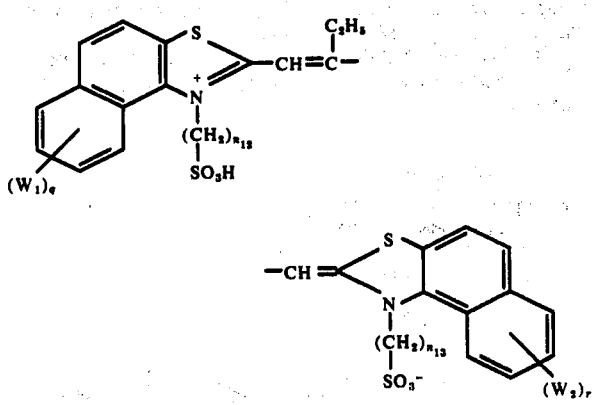

wherein $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, $q$ and $r$ each represents an integer ranging from 1 to 4 and $n_{12}$ and $n_{13}$ each represents an integer of from 1 to 4.

18. The silver halide emulsion as defined in claim 1, wherein said at least one cyanine sensitizing dye has the formula

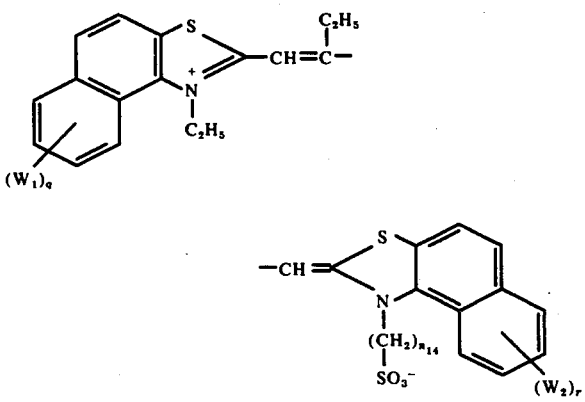

wherein $W_1$ and $W_2$ each represents a hydrogen atom, an alkyl group having 1 to 4 carbon atoms, an aryl group, a halogen atom, an alkoxy group having 1 to 4 carbon atoms, a carboxy group, an aralkyl group, a trifluoromethyl group, a hydroxy group, an alkoxycarbonyl group where the alkyl moiety has 1 to 4 carbon atoms, or a cyano group, $q$ and $r$ each represents an integer ranging from 1 to 4 and $n_{14}$ represents an integer of from 2 to 4.

19. A silver halide photographic emulsion supersensitized by a combination of 1. at least one cyanine dye represented by the General Formula (I) below; and
2. at least one benzotriazole compound substituted with at least one halogen atom having the following formula;

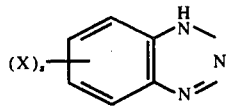

wherein X represents a chlorine, bromine or iodine atom, and s represents an integer from 1 to 4, and where when $s$ equals 2, 3 or 4, the halogen atom substituents may be the same as or different from one another, both (1) and (2) being present in a supersensitizing amount:

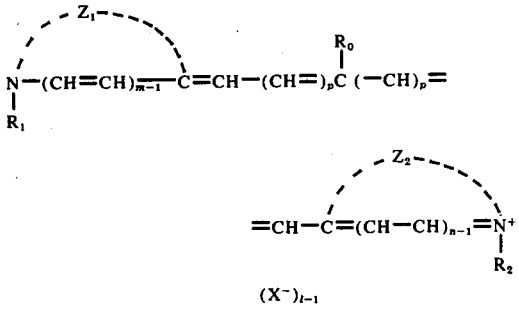

(I)

wherein $l$, $m$ and $n$ each represents 1 or 2, $p$ represents, 0, 1 or 2, $R_0$ represents hydrogen atom, an alkyl group, a carboxyalkyl group, a hydroxy alkyl group, an alkoxy group, an alkylthio group, an aralkyl group or an aryl group, and $X^-$ represents an inorganic or organic acid anion, where the dye forms an intermolecular salt when $l$ is 1, $R_1$ and $R_2$ each represents an aliphatic group, which may be saturated or unsaturated, or an aryl group, and $Z_1$ and $Z_2$ each represents a non-metallic atomic group necessary to complete a 5- or 6-membered nitrogen-containing heterocyclic ring.

20. A photographic light-sensitive material prepared by coating the silver halide photographic emulsion as defined in claim 1 on a support.

21. A photographic emulsion for a color sensitive material comprising the silver halide emulsion as defined in claim 1 in combination with one or more color couplers.

* * * * *